US010475633B2

(12) United States Patent
Dominguez et al.

(10) Patent No.: US 10,475,633 B2
(45) Date of Patent: Nov. 12, 2019

(54) RF ION GUIDE

(71) Applicant: DH Technologies Development Pte. Ltd., Singapore (SG)

(72) Inventors: Pablo Dominguez, Mississauga (CA); Hassan Javaheri, Richmond Hill (CA)

(73) Assignee: DH Technologies Development Pte. Ltd., Singapore (SG)

( * ) Notice: Subject to any disclaimer, the term of this patent is extended or adjusted under 35 U.S.C. 154(b) by 186 days.

(21) Appl. No.: 15/529,623

(22) PCT Filed: Nov. 28, 2014

(86) PCT No.: PCT/IB2014/002629
§ 371 (c)(1),
(2) Date: May 25, 2017

(87) PCT Pub. No.: WO2016/083857
PCT Pub. Date: Jun. 2, 2016

(65) Prior Publication Data

US 2017/0263429 A1 Sep. 14, 2017

(51) Int. Cl.

| | |
|---|---|
| ***H01J 49/06*** | (2006.01) |
| ***H01J 49/00*** | (2006.01) |
| ***H01J 49/24*** | (2006.01) |
| ***H01J 49/42*** | (2006.01) |

(52) U.S. Cl.
CPC ..... *H01J 49/063* (2013.01); *H01J 49/0031* (2013.01); *H01J 49/066* (2013.01); *H01J 49/24* (2013.01); *H01J 49/426* (2013.01); *H01J 49/4255* (2013.01)

(58) Field of Classification Search
USPC ..... 250/288
See application file for complete search history.

(56) References Cited

U.S. PATENT DOCUMENTS

| | | | | |
|---|---|---|---|---|
| 6,111,250 A * | 8/2000 | Thomson | H01J 49/4225 250/281 |
| 6,723,986 B2 * | 4/2004 | Kernan | H01J 49/063 250/292 |
| 6,909,089 B2 * | 6/2005 | Londry | H01J 49/4225 250/281 |
| 9,053,915 B2 * | 6/2015 | Ristroph | H01J 49/062 |
| 9,536,722 B2 * | 1/2017 | Grinfeld | H01J 49/0018 |
| 9,921,183 B2 * | 3/2018 | Schneider | G01N 27/624 |

(Continued)

OTHER PUBLICATIONS

International Search Report and Written Opinion for PCT/IB2014/002629 dated Aug. 26, 2015.

*Primary Examiner* — Phillip A Johnston

(57) ABSTRACT

A mass spectrometer is provided having an ion source for generating ions from a sample in a high pressure region, a first vacuum chamber having an inlet aperture, and an exit aperture. The at least one ion guide can be between the inlet and exit apertures and can include an entrance end and an exit end. The at least one ion guide can have a plurality of electrodes arranged around a central axis defining an ion channel, each of the plurality of electrodes being tapered, a planar surface of each of the plurality of tapered electrodes facing the interior of the at least one ion guide, and the surface gradually being narrowed and tilted inward to provide a smaller inscribed radius at the exit; and a power supply for providing an RF voltage to the at least one ion guide.

16 Claims, 7 Drawing Sheets

(56) References Cited

U.S. PATENT DOCUMENTS

| | | | | |
|---|---|---|---|---|
| 2007/0045533 | A1 | 3/2007 | Krutchinsky et al. | |
| 2011/0049360 | A1 | 3/2011 | Schoen | |
| 2013/0175440 | A1 | 7/2013 | Perelman et al. | |
| 2013/0175441 | A1 | 7/2013 | Zanon et al. | |
| 2013/0206973 | A1* | 8/2013 | Kovtoun ..... | H01J 49/063<br>250/282 |

* cited by examiner

RF ION GUIDE

FIELD

The applicant's teachings relate to a method and apparatus for transporting ions in a mass spectrometer, and more specifically to RF ion guides.

INTRODUCTION

In mass spectrometry, sample molecules are converted into ions using an ion source, in an ionization step, and then detected by a mass analyzer, in mass separation and detection steps. For most atmospheric pressure ion sources, ions pass through an inlet aperture prior to entering an ion guide in a first vacuum chamber. The ion guide transports and focuses ions from the ion source into a subsequent vacuum chamber, and a radio frequency signal can be applied to the ion guide to provide radial focusing of ions within the ion guide. However, during transportation of the ions through the ion guide, ion losses can occur. Therefore, it is desirable to increase transport efficiency of the ions along the ion guide and prevent the loss of ions during transportation to attain high sensitivity.

SUMMARY

In view of the foregoing, the applicant's teachings provide a mass spectrometer apparatus comprising an ion source for generating ions from a sample in a high-pressure region. In various aspects, a first vacuum chamber has an inlet aperture for passing the ions from the high-pressure region into the first vacuum chamber and an exit aperture for passing ions from the first vacuum chamber. In various aspects, the apparatus also comprises at least one ion guide. The at least one ion guide can be positioned in the chamber between the inlet aperture and an exit aperture so that when an RF voltage, provided by an RF power supply, is applied to the at least one ion guide, the ions can be radially confined within the internal volume of the at least one ion guide and focused and directed to the exit aperture. In various embodiments, the at least one ion guide has an entrance end and an exit end. In various embodiments, the at least one ion guide can comprise a predetermined cross section and length defining an internal volume. In various aspects, the predetermined cross section of the at least one ion guide can form an inscribed circle. In various embodiments, the entrance end comprises an opening with an inscribed circle that is larger than the inscribed circle that comprises the exit end. In various aspects, the inscribed circle at the entrance end has a diameter of between about 8 mm and about 20 mm. In various aspects, the size of the inlet and exit apertures can dictate the diameter of the entrance and exit ends of the ion guide. In various embodiments, the entrance end of the ion guide has a diameter of between about 7 mm and about 12 mm. In various aspects, the inscribed circle at the exit end has a diameter of between about 1.5 mm and about 10 mm. In various embodiments, the exit end of the ion guide has a diameter between about 1.5 mm and about 2.5 mm. In various aspects, the at least one ion guide comprises a plurality of electrodes arranged around a central axis defining an ion channel. In various aspects, each of the plurality of electrodes can be tapered, and a planar surface of each of the plurality of tapered electrodes can face the interior of the at least one ion guide, the surface gradually being narrowed and tilting inward to provide a smaller inscribed radius at the exit. In various aspects, the surface of each of the plurality of tapered electrodes can be any suitable shape. In various aspects, the surface can be curved. In various aspects, the surface can be convex or concave. In various aspects, a power supply can provide an RF voltage to the at least one ion guide.

In various embodiments, there is a greater resistance to the radial flow of gas from the interior to the exterior of the ion guide at the exit end than at the entrance end. In various aspects, the spacing between adjacent electrodes is essentially constant over the length of the ion guide. In various aspects, the spacing between adjacent electrodes is between about 0.4 mm to about 1.5 mm. In various embodiments, each of the plurality of electrodes gradually becomes thicker towards the narrower exit end of the ion guide, the thickness being in the direction approximately perpendicular to the central axis. In various embodiments, each of the plurality of electrodes can be approximately four times thicker at the exit end than at the entrance end. In various aspects, the length of the electrodes comprises between about 5 cm to about 50 cm. In various aspects, the diameter of the inlet aperture can be between about 0.15 mm to about 5 mm. In various aspects, the diameter of the exit aperture can be about 0.5 mm to about 20 mm. In various aspects, the at least one ion guide can be attached to a printed circuit board. In various aspects, the first vacuum chamber can have a pressure between about 1 torr to about 100 torr. In various embodiments, the first vacuum chamber can have a pressure between about 6 torr and about 12 torr. In various aspects, the at least one ion guide can comprise a multipole. In various embodiments, the multipole can comprise any suitable number of electrodes. In various aspects, the multipole can comprise any even number of electrodes. In various embodiments, the multipole can be selected from an ion guide having four electrodes, six electrodes, eight electrodes, ten electrodes, twelve electrodes, fourteen electrodes, and sixteen electrodes. In various embodiments, twelve electrodes are provided that are separated by a gap of approximately 0.4 mm and have a thickness in the direction approximately perpendicular to the central axis that increases from approximately 1.5 mm at the entrance end to approximately 6 mm at the exit end.

The applicant's teachings provide a method of performing mass analysis. In various aspects, the method comprises an ion source for generating ions from a sample in a high-pressure region. In various aspects, there is provided a first vacuum chamber having an inlet aperture for passing the ions from the high-pressure region into the first vacuum chamber and an exit aperture for passing ions from the first vacuum chamber. In various aspects, the method also comprises at least one ion guide. The at least one ion guide can be positioned in the chamber between the inlet aperture and an exit aperture so that when an RF voltage, provided by an RF power supply, is applied to the at least one ion guide, the ions can be radially confined within the internal volume of the at least one ion guide and focused and directed to the exit aperture. In various embodiments, the method comprises a second vacuum chamber following the first vacuum chamber, where the pressure in the second vacuum chamber is lower than the pressure in the first vacuum chamber. A second ion guide in the second vacuum chamber can be provided to further focus the ions through the second vacuum chamber. In various embodiments, the at least one ion guide has an entrance end and an exit end. In various embodiments, the entrance end comprises an opening with an inscribed circle that is larger than the inscribed circle that comprises the exit end. In various aspects, the inscribed circle at the entrance end has a diameter of between about 8 mm and about 20 mm. In various aspects, the inscribed circle at the exit end has a diameter of between about 1.5 mm and about 10 mm. In various aspects, the size of the inlet and exit apertures can dictate the diameter of the entrance and exit ends of the ion guide. In various embodiments, the entrance end of the ion guide has a diameter of between about 7 mm and about 12 mm. In various embodiments, the exit end of the ion guide has a diameter between about 1.5 mm and about 2.5 mm. In various aspects, the at least one ion guide comprises a plurality of electrodes arranged around a central axis defining an ion channel. In various aspects, each of the plurality of electrodes being tapered, and a planar surface of each of the plurality of tapered electrodes facing the interior of the at least one ion guide, the surface gradually being narrowed and tilted inward to provide a smaller inscribed radius at the exit. In various aspects, the surface of each of the plurality of tapered electrodes can be any suitable shape. In various aspects, the surface can be curved. In various aspects, the surface can be convex or concave. In various aspects, a power supply can provide an RF voltage to the at least one ion guide.

In various embodiments, there is a greater resistance to the radial flow of gas from the interior to the exterior of the ion guide at the exit end than at the entrance end. In various aspects, the spacing between adjacent electrodes is essentially constant over the length of the ion guide. In various aspects, the spacing between adjacent electrodes is between about 0.4 mm to about 1.5 mm. In various embodiments, each of the plurality of electrodes gradually becomes thicker towards the narrower exit end of the ion guide, the thickness being in the direction approximately perpendicular to the central axis. In various embodiments, each of the plurality of electrodes can be approximately four times thicker at the exit end than at the entrance end. In various aspects, the length of the electrodes comprises between about 5 cm to about 50 cm. In various aspects, the diameter of the inlet aperture can be between about 0.15 mm to about 5 mm. In various aspects, the diameter of the exit aperture can be about 0.5 mm to about 20 mm. In various aspects, the at least one ion guide can be attached to a printed circuit board. In various aspects, the first vacuum chamber can have a pressure between about 1 torr to about 100 torr. In various embodiments, the first vacuum chamber can have a pressure between about 6 torr and about 12 torr. In various aspects, the at least one ion guide can comprise a multipole. In various aspects, the multipole can have any even number of electrodes. In various embodiments, the multipole can comprise any suitable number of electrodes. In various embodiments, the multipole can be selected from an ion guide having four electrodes, six electrodes, eight electrodes, ten electrodes, twelve electrodes, fourteen electrodes, and sixteen electrodes. In various embodiments, twelve electrodes are provided that are separated by a gap of approximately 0.4 mm and have a thickness in the direction approximately perpendicular to the central axis that increases from approximately 1.5 mm at the entrance end to approximately 6 mm at the exit end.

The applicant's teachings provide a mass spectrometer apparatus comprising an ion source for generating ions from a sample in a high-pressure region. In various aspects, a first vacuum chamber has an inlet aperture for passing the ions from the high-pressure region into the first vacuum chamber and an exit aperture for passing ions from the first vacuum chamber. In various aspects, the apparatus also comprises at least one ion guide between the inlet aperture and the exit aperture. In various embodiments, the at least one ion guide has an entrance end and an exit end. In various aspects, the at least one ion guide comprises a plurality of planar electrodes arranged around a central axis defining an ion channel. In various aspects, each of the plurality of electrodes can be folded, or bent, along the length of the ion guide to form a gradually narrowing planar surface that faces the interior of the at least one ion guide. In various aspects, the planar surface can become narrower towards the end of each of the electrodes. In various aspects, a second planar surface is approximately orthogonal to the axis of the ion guide. In various aspects, a power supply can provide an RF voltage to the at least one ion guide.

In various embodiments, the plurality of electrodes can be folded at about 90 degrees. In various aspects, each of the plurality of electrodes can be tapered. In various embodiments, the length of the electrodes can be between about 5 cm and about 50 cm. In various aspects, the spacing between adjacent electrodes can be constant and can be between about 0.1 mm to about 1.5 mm. In various aspects, the diameter of the inlet aperture can be between about 0.15 mm to about 5 mm. In various aspects, the diameter of the exit aperture can be about 0.5 mm to about 20 mm. In various aspects, the size of the inlet and exit apertures can dictate the diameter of the entrance and exit ends of the ion guide. In various embodiments, the entrance end of the ion guide has a diameter of between about 7 mm and about 12 mm. In various embodiments, the exit end of the ion guide has a diameter between about 1.5 mm and about 2.5 mm. In various aspects, the at least one ion guide can be attached to a printed circuit board. In various aspects, the first vacuum chamber can have a pressure between about 1 torr to about 100 torr. In various embodiments, the first vacuum chamber can have a pressure between about 6 torr and about 12 torr. In various aspects, the electrodes can be comprised of sheet or shim metal. In various embodiments, the electrodes can be machined. In various aspects, the at least one ion guide can comprise a multipole. In various embodiments, the multipole can comprise any suitable number of electrodes. In various aspects, the multipole can have any even number of electrodes. In various embodiments, the multipole can be selected from an ion guide having four electrodes, six electrodes, eight electrodes, ten electrodes, twelve electrodes, fourteen electrodes, and sixteen electrodes.

The applicant's teachings provide a method for performing mass analysis comprising generating ions from a sample in a high-pressure region. In various aspects, a first vacuum chamber can be provided having an inlet aperture for passing the ions from the high-pressure region into the first vacuum chamber and an exit aperture for passing ions from the first vacuum chamber. In various aspects, at least one ion guide can be provided between the inlet aperture and the exit aperture. In various embodiments, the at least one ion guide has an entrance end and an exit end. In various aspects, the at least one ion guide comprises a plurality of planar electrodes arranged around a central axis defining an ion channel. In various aspects, each of the plurality of electrodes can be folded, or bent, along the length of the ion guide to form a gradually narrowing planar surface that faces the interior of the at least one ion guide. In various aspects, the planar surface can become narrower towards the end of each of the electrodes. In various aspects, a second planar surface can be approximately orthogonal to the axis of the ion guide. In various aspects, a power supply can be provided for providing an RF voltage to the at least one ion guide.

In various embodiments, the plurality of electrodes can be folded at about 90 degrees. In various aspects, each of the plurality of electrodes can be tapered. In various embodiments, the length of the electrodes can be between about 5 cm and about 50 cm. In various aspects, the spacing between adjacent electrodes can be constant and can be between about 0.1 mm to about 1.5 mm. In various aspects, the diameter of the inlet aperture can be between about 0.15 mm to about 5 mm. In various aspects, the diameter of the exit aperture can be about 0.5 mm to about 20 mm. In various aspects, the size of the inlet and exit apertures can dictate the diameter of the entrance and exit ends of the ion guide. In various embodiments, the entrance end of the ion guide has a diameter of between about 7 mm and about 12 mm. In various embodiments, the exit end of the ion guide has a diameter between about 1.5 mm and about 2.5 mm. In various aspects, the at least one ion guide can be attached to a printed circuit board. In various aspects, the first vacuum chamber can have a pressure between about 1 torr to about 100 torr. In various embodiments, the first vacuum chamber can have a pressure between about 6 torr and about 12 torr. In various aspects, the electrodes can be comprised of metal. In various embodiments, the electrodes can be formed from sheet or shim metal. In various aspects, the at least one ion guide can comprise a multipole. In various embodiments, the multipole can comprise any suitable number of electrodes. In various aspects, the multipole can have any even number of electrodes. In various embodiments, the multipole can be selected from an ion guide having four electrodes, six electrodes, eight electrodes, ten electrodes, twelve electrodes, fourteen electrodes, and sixteen electrodes.

BRIEF DESCRIPTION OF THE DRAWINGS

The skilled person in the art will understand that the drawings, described below, are for illustration purposes only. The drawings are not intended to limit the scope of the applicant's teachings in any way.

In the drawings, like reference numerals indicate like parts.

DESCRIPTION OF VARIOUS EMBODIMENTS

Figure 1:
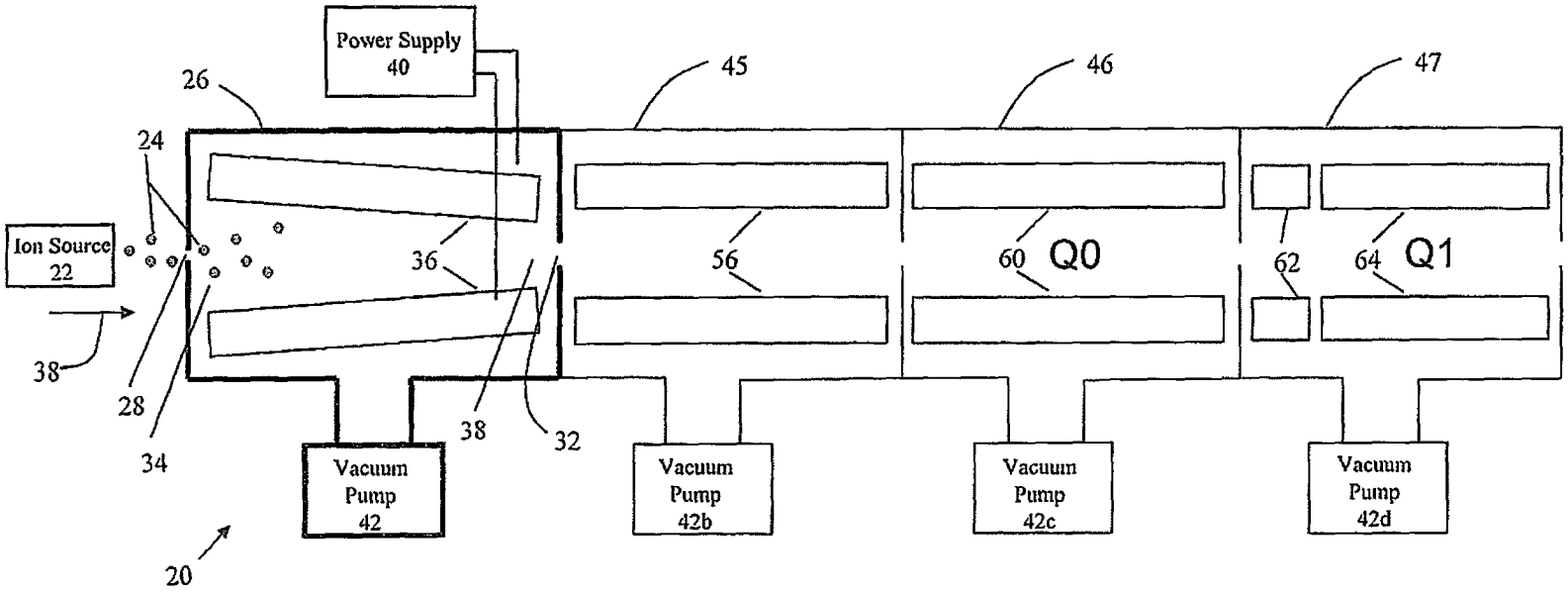
FIG. 1 is a schematic view of a mass spectrometer according to various embodiments of the applicant's teachings.

It should be understood that the phrase "a" or "an" used in conjunction with the applicant's teachings with reference to various elements encompasses "one or more" or "at least one" unless the context clearly indicates otherwise. An apparatus for performing mass analysis is provided. Reference is first made to FIG. 1, which shows schematically a mass spectrometer, generally indicated by reference number 20 according to various embodiments of the applicant's teachings. In various embodiments, the mass spectrometer 20 comprises an ion source 22 for generating ions 24 from a sample of interest, not shown. In various embodiments, the ion source 22 can be positioned in a high-pressure region containing a background gas, while the ions 24 travel towards a first vacuum chamber 26, in the direction indicated by the arrow 38. The ions enter the chamber 26 through an inlet aperture 28, where the ions are entrained by a supersonic flow of gas, typically referred to as a supersonic free jet expansion as described, for example, in applicant's U.S. Pat. Nos. 7,256,395 and 7,259,371 herein incorporated by reference.

In various aspects, the ions 24 can travel towards a first vacuum chamber 26, in the direction indicated by the arrow 38. In various aspects, a vacuum pump 42 can provide suitable vacuum to first vacuum chamber 26. In various aspects, the first vacuum chamber can comprise a pressure between about 1 torr to about 100 torr. In various embodiments, the first vacuum chamber can have a pressure between about 6 torr and about 12 torr. The pressure in the first vacuum chamber 26 can be maintained by pump 42, and power supply 40 can be connected to the at least one ion guide 36 to provide RF voltage in a known manner for radially confining, focusing, and passing ions 24 from the first vacuum chamber 26. In various embodiments, the first vacuum chamber 26 can comprise an inlet aperture 28 for passing the ions into the first vacuum chamber 26 and an exit aperture 32 located downstream from the inlet aperture 28. In various aspects, the exit aperture 32 can separate the first vacuum chamber 26 from the next or second vacuum chamber 45 which can house a further ion guide 56, as exemplified in FIGS. 1, 4 and 7. In various aspects, the pressure of the second vacuum chamber can be between about 1 torr and about 3 torr. In various aspects, a vacuum pump 42*b* can provide suitable vacuum to second vacuum chamber 45. In various aspects, subsequent vacuum chambers, 46 and 47, can be provided with respective vacuum pumps, 42*c* and 42*d*. Vacuum chambers 46 and 47 can house an ion guide 60 or mass analyzer 64. Vacuum chamber 47 can further comprise stubby rods 62. In various aspects, one or more power supplies can supply voltages to ion guides 36 and 56.

In various embodiments, declustering voltages can be provided between apertures and RF ion guides in order to decluster ions. Declustering voltages can comprise DC voltage differences between ion optical elements such as metal plates containing apertures and RF ions guides, or between two RF ion guides, the DC voltage difference acting to increase the velocity of ions in the background gas, exciting the ions by means of collisions to remove any residual neutral clusters that remain on the ions, or even to fragment ions if so desired. The DC voltage differences can be provided to various ion optical elements by DC power supplies (not shown) in a known manner. The DC voltage differences, sometimes referred to as declustering voltages, can be controlled in order to control the amount of declustering or fragmentation, as is known in the art. In various embodiments, declustering or fragmentation voltages can be provided, for example, between the plate containing the inlet aperture 28 and the first RF ion guide 36, between ion guide 36 and the plate containing exit aperture 32, or between exit aperture 32 and RF ion guide 56, or between the vacuum chambers 45 and 46. In various embodiments, more than one declustering voltage in more than one location can be applied. In various embodiments, RF ion guides 36 or 56 can comprise two or more segments. In various embodiments, declustering voltages can be provided between two or more segments of RF ion guides located in any of said vacuum chambers 26, 45, 46 or 47. In various embodiments, declustering voltages can be provided between any ion optical element such as a plate aperture or ion focusing lens or RF ion guide, and any adjacent ion optical elements through which the ions are directed.

Figure 2:
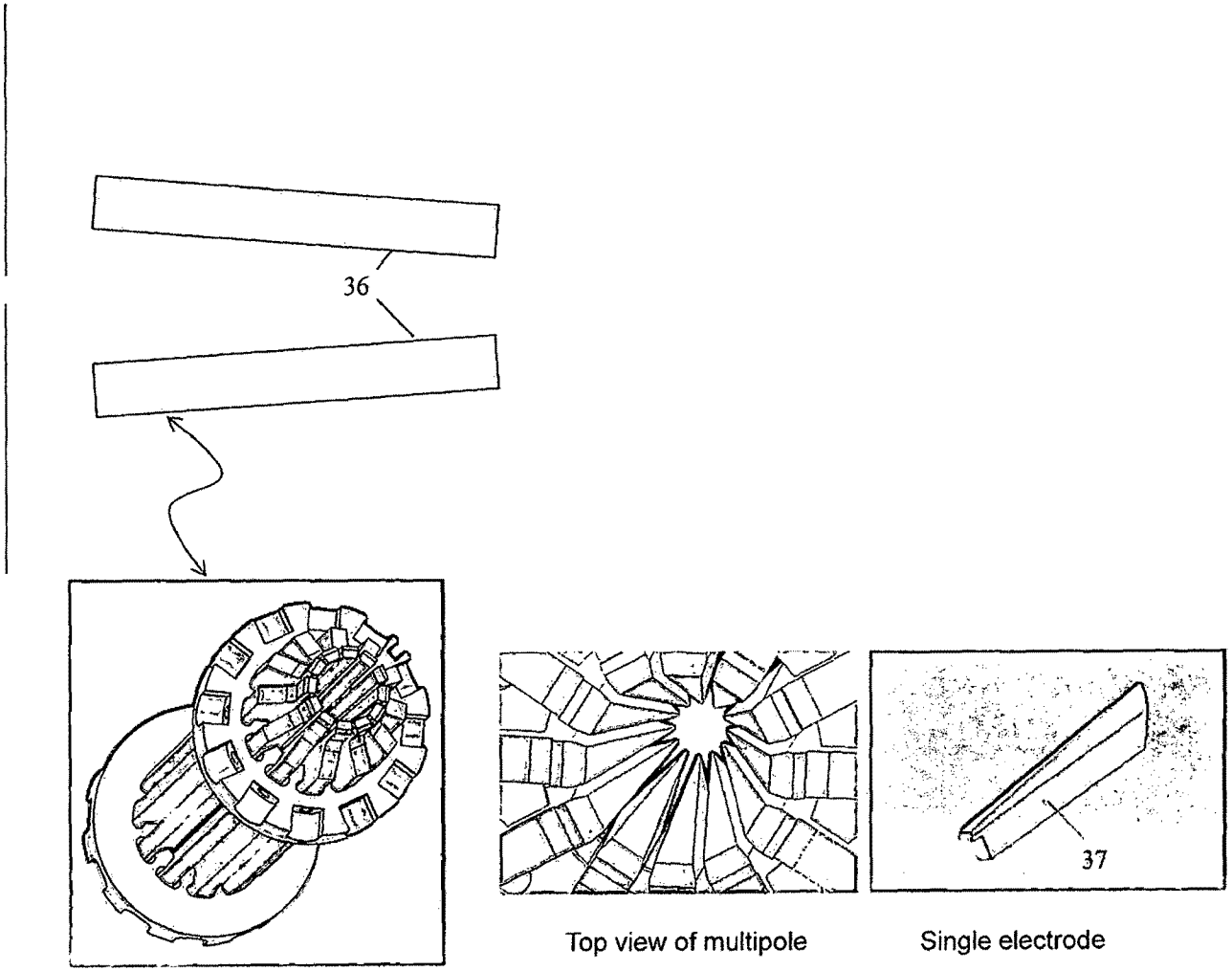
FIG. 2 schematically illustrates an ion guide according to the applicant's teachings and shows a cross-sectional view of the ion guide according to various embodiments of the applicant's teachings.

As shown in FIG. 2, in various embodiments, the at least one ion guide 36 of FIG. 1, between the inlet 28 and exit apertures 32 of vacuum chamber 26 and having an entrance end 34 and an exit end 38, can comprise a plurality of electrodes arranged around a central axis defining an ion channel. In various aspects, the plurality of electrodes can be tapered, a planar surface of each of the plurality of tapered electrodes facing the interior of the at least one ion guide, and the surface gradually being narrowed and tilting inward to provide a smaller inscribed radius at the exit end. In various aspects, the surface of each of the plurality of tapered electrodes can be any suitable shape. In various aspects, the surface can be curved. In various aspects, the surface can be convex or concave. In various aspects, a power supply can provide an RF voltage to the at least one ion guide. FIG. 2 shows a top view or view from the entrance of the multipole as well as a single electrode 37.

In various embodiments, each of the plurality of electrodes gradually becomes thicker towards the narrower exit end of the ion guide, the thickness being in the direction approximately perpendicular to the central axis of the ion guide. In various aspects, each of the plurality of electrodes is approximately four times thicker at the exit end than at the entrance end.

In various embodiments, the spacing between adjacent electrodes can be essentially constant over the length of the ion guide. In various aspects, the spacing between adjacent electrodes can be between about 0.4 mm to about 1.5 mm.

In various embodiments, the gas flow through inlet aperture 28 comprises a free jet expansion, in which the gas and ions are directed at high velocities through a barrel-shaped region into the interior of the RF ion guide as described, for example, in applicant's U.S. Pat. Nos. 7,256,395 and 7,259,371 herein incorporated by reference. In various embodiments, the entrance diameter of RF ion guide 36 can be selected to be at least 80% of the diameter of the barrel shock of the free jet. This ensures that a large proportion of the ions that are entrained in the free jet is captured by the RF ion guide, and can be focused by the RF fields in the ion guide. The large gas flow that is also contained within the boundaries of the free jet escapes through the gaps between the electrodes of the RF ion guide and is pumped away by vacuum pump 42 in order to maintain the vacuum pressure in chamber 26. This gas flow from the interior of the ion guide to the vacuum pump 42 comprises a radial gas flow.

Figure 3:
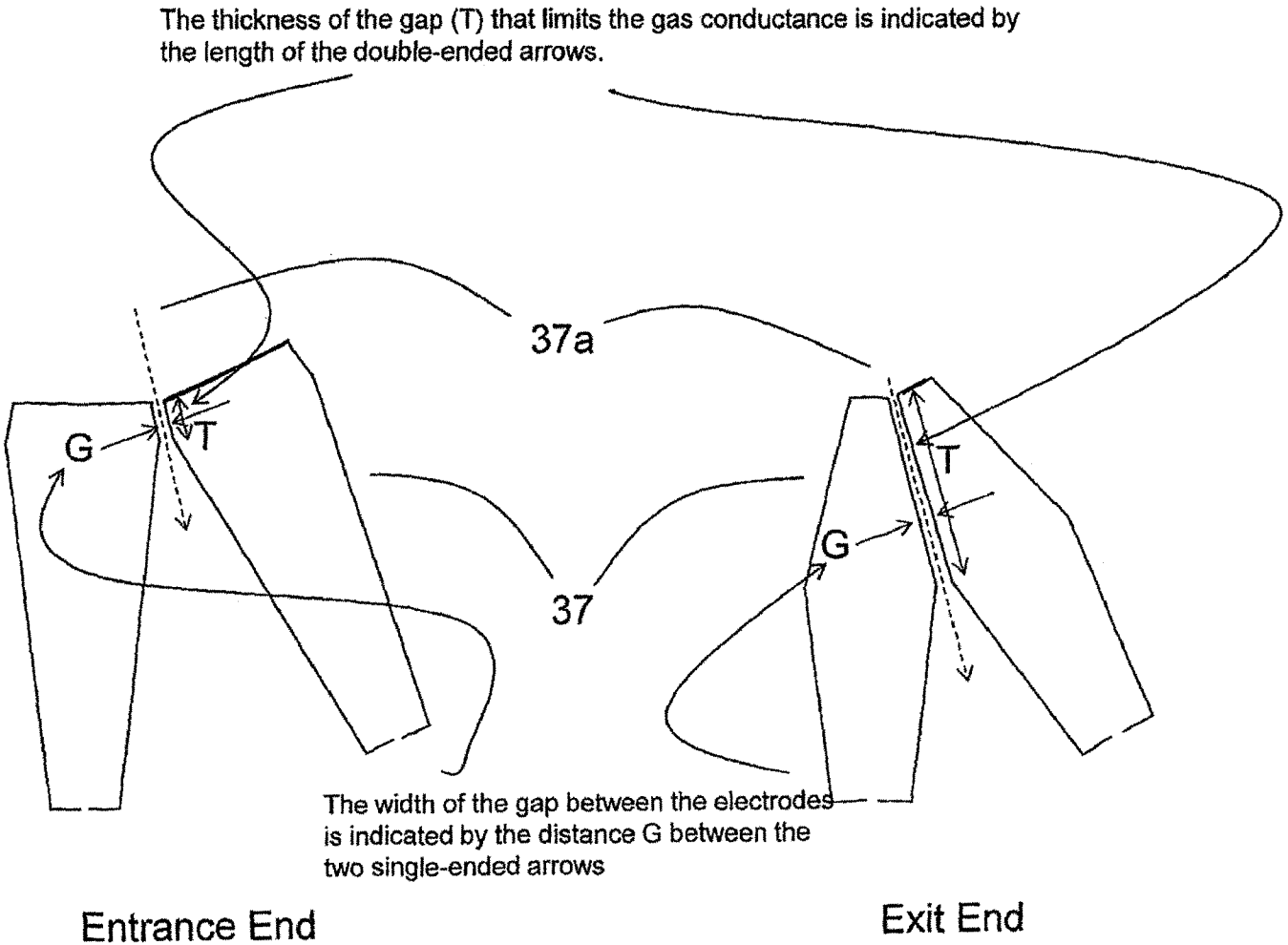
FIG. 3 schematically illustrates adjacent electrodes according to various embodiments of the applicant's teachings.

In various embodiments, there is a greater resistance to the radial flow of gas from the interior to the exterior of the ion guide at the exit end than at the entrance end. As shown in FIG. 3, the width of the gap G (dimension indicated by the distance between the two single-ended solid arrows) between adjacent electrodes, combined with the thickness of the electrodes T (dimension indicated by the double-ended solid arrows) in a direction perpendicular to the axis of the ion guide, comprises a channel through which the gas 37*a*, indicated by the dotted arrows, must flow to escape from the interior of the ion guide. The resistance to radial gas flow can be greater at the exit end of the ion guide because the electrodes 37 are thicker at the exit end than at the entrance end, thereby reducing the gas conductance or increasing the resistance to radial gas flow. The thicker channel comprises a greater resistance to gas flow than does a thinner channel, thereby reducing the radial gas flow outward at the exit end than at the entrance end. This reduces the tendency of the gas to drag the ions outward through the gaps of the ion guide, thereby improving the ability of the RF ion guide to contain the ions within the ion guide, and to focus the ions through the exit aperture 32.

In various embodiments, the ion guide can comprise twelve electrodes, each electrode separated from adjacent electrodes by a gap of approximately 0.4 mm. In various embodiments, the twelve electrodes can have a thickness T in the direction approximately perpendicular to the central axis that increases from approximately 1.5 mm at the entrance end to approximately 6 mm at the exit end. In various embodiments, the thickness T is approximately 4 times greater at the exit than at the entrance.

In various aspects, the length of the electrodes is between about 5 cm to about 50 cm. In various aspects, the diameter of the inlet aperture 28 is about 0.15 mm to about 5 mm. In various aspects, the diameter of the exit aperture 32 is about 0.5 mm to about 20 mm. In various aspects, the size of the inlet and exit apertures can dictate the diameter of the entrance and exit ends of the ion guide. In various embodiments, the diameter of the entrance end of the ion guide can be selected to be at least 80% of the diameter of the diameter of the free jet. In various embodiments, the entrance end of the ion guide can have a diameter of between about 7 mm and about 12 mm. In various embodiments, the exit end of the ion guide has a diameter between about 1.5 mm and about 2.5 mm.

In various aspects, the pressure of the first vacuum chamber can be between about 1 torr to about 100 torr. In various embodiments, the first vacuum chamber can have a pressure between about 6 torr and about 12 torr.

In various embodiments, the at least one ion guide can comprise a multipole. In various embodiments, the multipole can comprise any suitable number of electrodes. In various aspects, the multipole can comprise any even number of electrodes. In various aspects, the multipole is selected from four electrodes, six electrodes, eight electrodes, ten electrodes, twelve electrodes, fourteen electrodes, and sixteen electrodes. In various embodiments, the multipole can comprise odd numbers of electrodes by suitably adjusting the phase of the RF voltages between poles as is known in the art.

Figure 4:
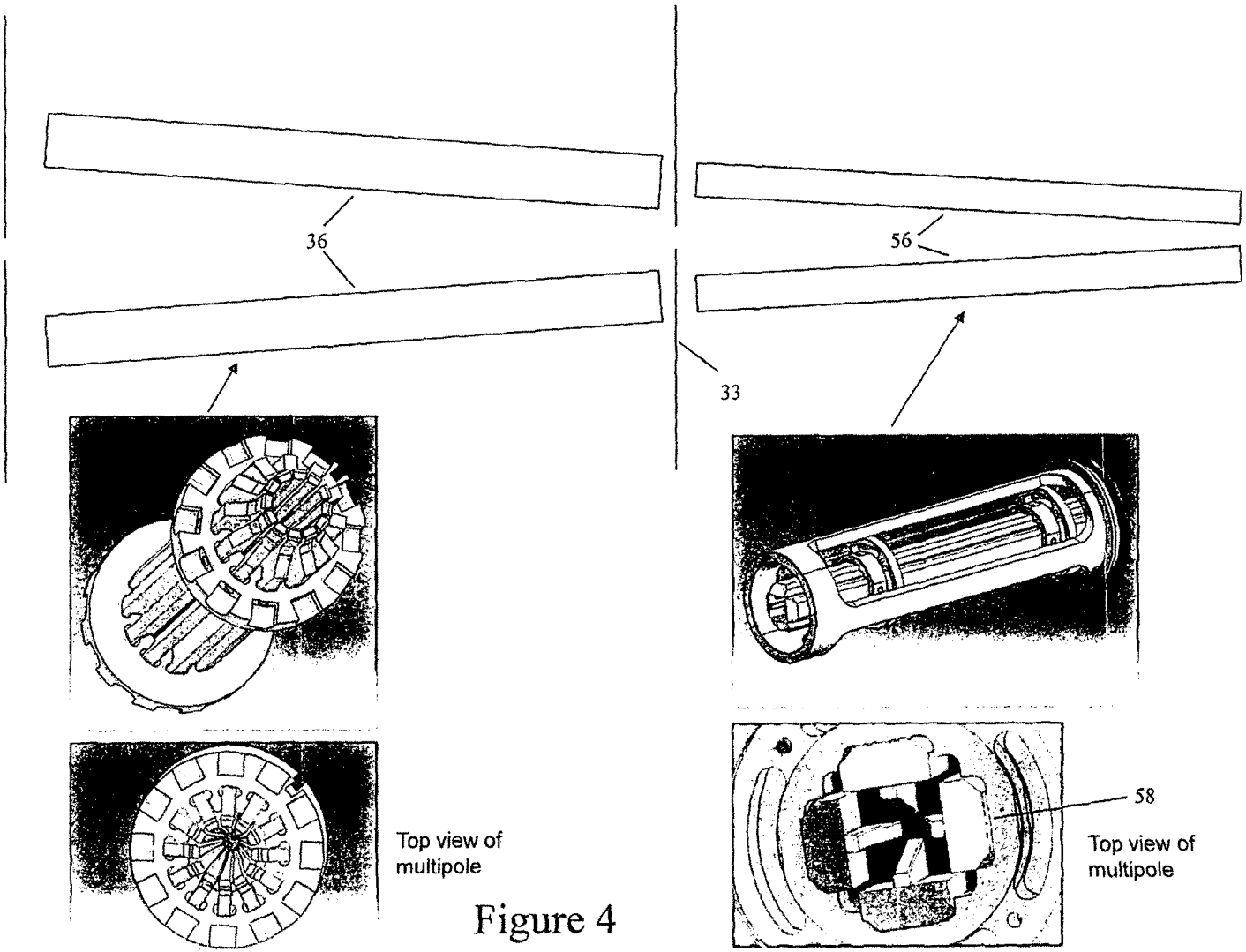
FIG. 4 illustrates a series of ion guides according to the applicant's teachings and shows a cross-sectional view of the ion guides according to various embodiments of the applicant's teachings.

In various embodiments, the at least one ion guide can comprise a series of multipole ion guides. In various aspects, the series of multipole ion guides can comprise any suitable configuration of rods. In various embodiments, as exemplified in FIG. 4, the at least one guide 36 can comprise the plurality of electrodes of FIG. 2, and the at least second ion guide 56 can comprise flat, T-shaped rods 58. In various aspects, the T-shaped rods can have flat surfaces that can face the interior of the ion guide. In various aspects, the at least second ion guide can have an entrance end diameter that is larger than the exit end diameter. As shown in FIG. 4, the stems of the T-shaped electrodes can be tilted so that the exit end diameter is smaller than the entrance end diameter. In various aspects, the at least second ion guide can have an entrance end diameter that can be selected to capture the ion beam that is emitted from the first ion guide. In various aspects, the second ion guide can comprise electrodes that are round, flat, rectangular, oval, T-shaped, or any other suitable shape. In various embodiments, the second ion guide can comprise a ring guide or ion funnel as is known in the art. FIG. 4 shows a top view of the multipole of the first ion guide 36 and a top view of the multipole of the second ion guide 56. In various embodiments, the second ion guide may converge toward the exit as shown in FIG. 4, or may be straight so that the entrance and exit ends are of the same diameter. In various aspects, the first ion guide and second ion guide can have RF frequencies of between about 1 MHz and about 10 MHz. In various aspects, the first ion guide can have an RF frequency of about 3 MHz, and the second ion guide can have an RF frequency of about 1.5 MHz. In various embodiments, the ion guides can have voltages between about 20 volts and about 300 volts. As is known in the art, the RF voltages of the ion guides can be adjusted to provide optimum transmission of different m/z values of the ions. In various embodiments, the RF voltages of the ion guides can be scanned as a function of the m/z value of the first mass filter or scanned in order to provide the desired or suitable transmission efficiency. In various embodiments, the RF voltage of the ion guides can be selected to reduce the transmission efficiency of ions of selected mass range in order to reduce the ion flux. For example, in some cases, it is desirable to reduce the ion current in order to reduce space charge effects in parts of the mass spectrometer system further downstream or to reduce saturation effects on the ion detector, the RF voltage of any of the ion guides in the mass spectrometer can be used to throttle the intensity of the ion beam by suitably increasing or decreasing the RF voltage or the RF frequency from the value that provides maximum transmission.

In various embodiments, the RF voltage of the second ion guide can be selected to be a fixed percentage or ratio of the RF voltage of the first ion guide. In various embodiments, the RF voltage of the second ion guide can be provided by dividing the RF voltage from the first ion guide through a capacitive divider as is known in the art.

In various aspects, the at least one ion guide can comprise a first ion guide 36 followed by at least a second ion guide 56 wherein the at least second ion guide 56 comprises a smaller diameter than the first ion guide 36. In various aspects, the series of multipole ion guides can include any number of electrodes, including quadrupole, hexapole, octapole, higher number of poles, or any combination thereof. In various aspects, the second ion guide, 56, can be located in a separate vacuum chamber, separated from the first vacuum chamber by an aperture plate, 33, as shown in FIG. 4. The pressure in the second chamber can be at a lower pressure than the pressure in the first vacuum chamber. In various embodiments, the pressure in the first vacuum chamber can be in the range of about 6 torr to about 12 torr. In various embodiments, the pressure in the second vacuum chamber can be in the range of between about 1 torr to about 3 torr.

In various aspects, the second ion guide can be located in the same vacuum chamber, at the same pressure, as the first ion guide. In various embodiments, the at least first and second ion guides can be mounted on a single flange as a unit which can be removed for service or replacement. Each ion guide can be separately removable from the flange. The flange can accommodate the RF connections and the capacitive divider so that connection to the RF power supply can be provided by inserting the flange into position, the RF connections being made by a suitable series of electrical plugs and sockets on the mounting chamber.

Figure 5:
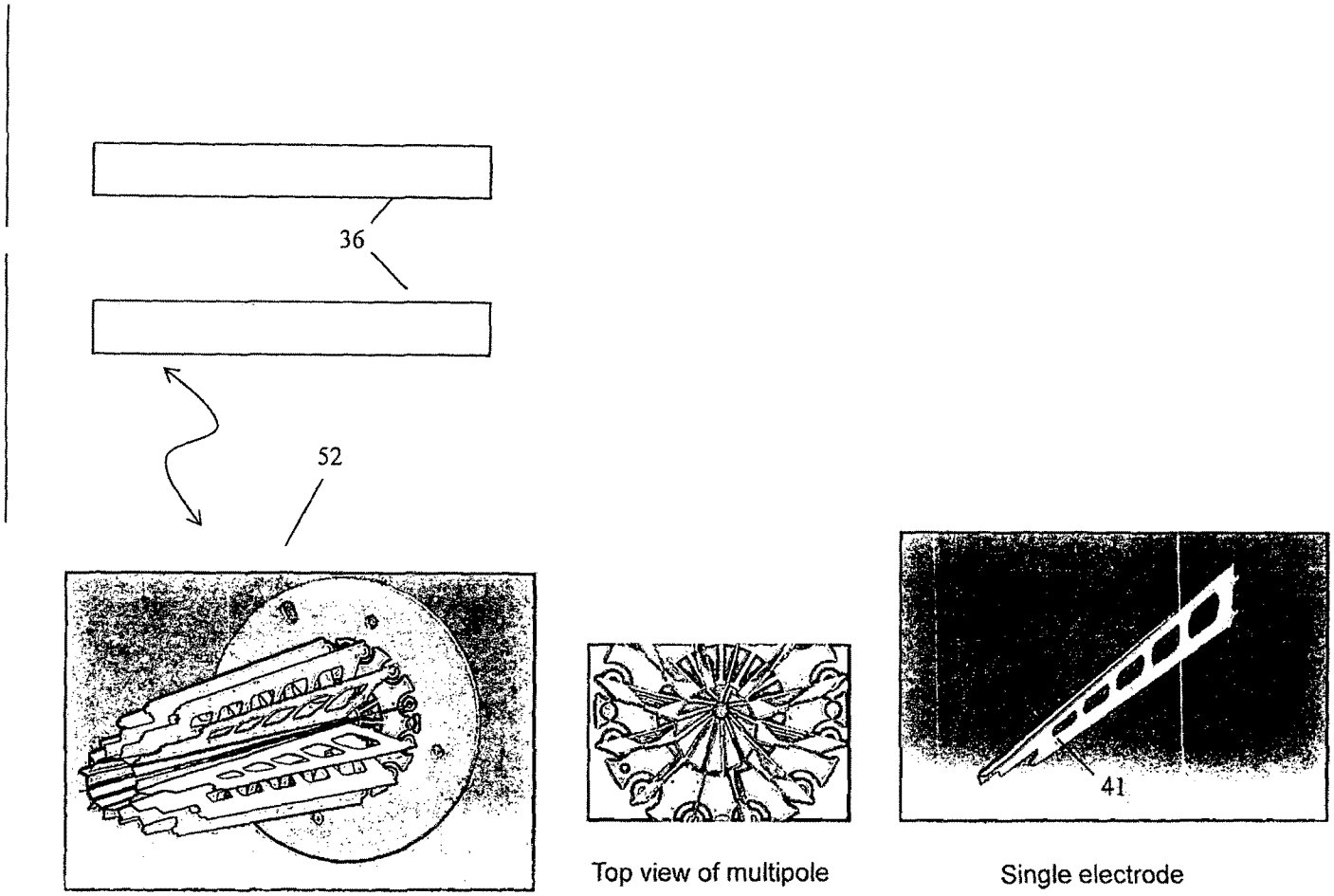
FIG. 5 schematically illustrates an ion guide according to the applicant's teachings and shows a cross-sectional view of the ion guide according to various embodiments of the applicant's teachings.

As shown in FIG. 5, in various embodiments, the at least one ion guide 36 of FIG. 1, between the inlet 28 and exit apertures 32 of vacuum chamber 26 and having an entrance end 34 and an exit end 38, can comprise a plurality of planar electrodes 52 defining an ion channel, each of the plurality of planar electrodes being folded, or bent, along the length of the ion guide to form a gradually narrowing planar surface 39 that faces the interior of the at least one ion guide. In various aspects, the planar surface can become narrower towards the end of each of the electrodes. In various aspects, each of the plurality of electrodes can be tapered. In various aspects, a second planar surface, 41, is approximately orthogonal to the axis of the ion guide. In various aspects, a power supply can provide an RF voltage to the at least one ion guide.

In various aspects, the plurality of electrodes can be folded at about 90 degrees. In various aspects, the length of the electrodes can be between about 5 cm to about 50 cm. In various aspects, the spacing between adjacent electrodes can be constant and can be between about 0.1 mm to about 1.5 mm. In various embodiments, the diameter of the inlet aperture can be between about 0.15 mm to about 5 mm. In various aspects, the diameter of the exit aperture can be between about 0.5 mm to about 20 mm. In various aspects, the size of the inlet and exit apertures can dictate the diameter of the entrance and exit ends of the ion guide. In various embodiments, the entrance end of the ion guide has a diameter of between about 7 mm and about 12 mm. In various embodiments, the exit end of the ion guide has a diameter between about 1.5 mm and about 2.5 mm. In various embodiments, the electrodes of the at least one ion guide can be individually attached or soldered to a printed circuit board at the entrance end and a printed circuit board at the exit end. The printed circuit boards can provide a mechanical mounting for the electrodes and can provide electrical connections to the electrodes. Electrical components such as capacitors or resistors which supply RF and DC voltages to the electrodes of the ion guide can be mounted or soldered on the printed circuit board. The printed circuit board can contain all circuit connections and tracks as is known in conventional printed circuit boards in order to reduce the need to use wires to connect individual components. In various aspects, the aperture plates containing the apertures such as aperture 32 in FIG. 1 can be mounted on the printed circuit board. In various aspects, the printed circuit board can form part of the vacuum barrier between adjacent chambers. In various aspects, the pressure of the first vacuum chamber can be between about 1 torr to about 100 torr. In various embodiments, the first vacuum chamber can have a pressure between about 6 torr and about 12 torr. In various embodiments, the electrodes can be comprised of metal. In various embodiments, the electrodes can be formed from sheet or shim metal. In various aspects, the at least one ion guide can comprise a multipole. In various embodiments, the multipole can comprise any suitable number of electrodes. In various aspects, the multipole can comprise any even number of electrodes. In various embodiments, the multipole can be selected from four electrodes, six electrodes, eight electrodes, ten electrodes, twelve electrodes, fourteen electrodes, and sixteen electrodes. In various aspects, a power supply can provide an RF voltage to the at least one ion guide.

Figure 6:
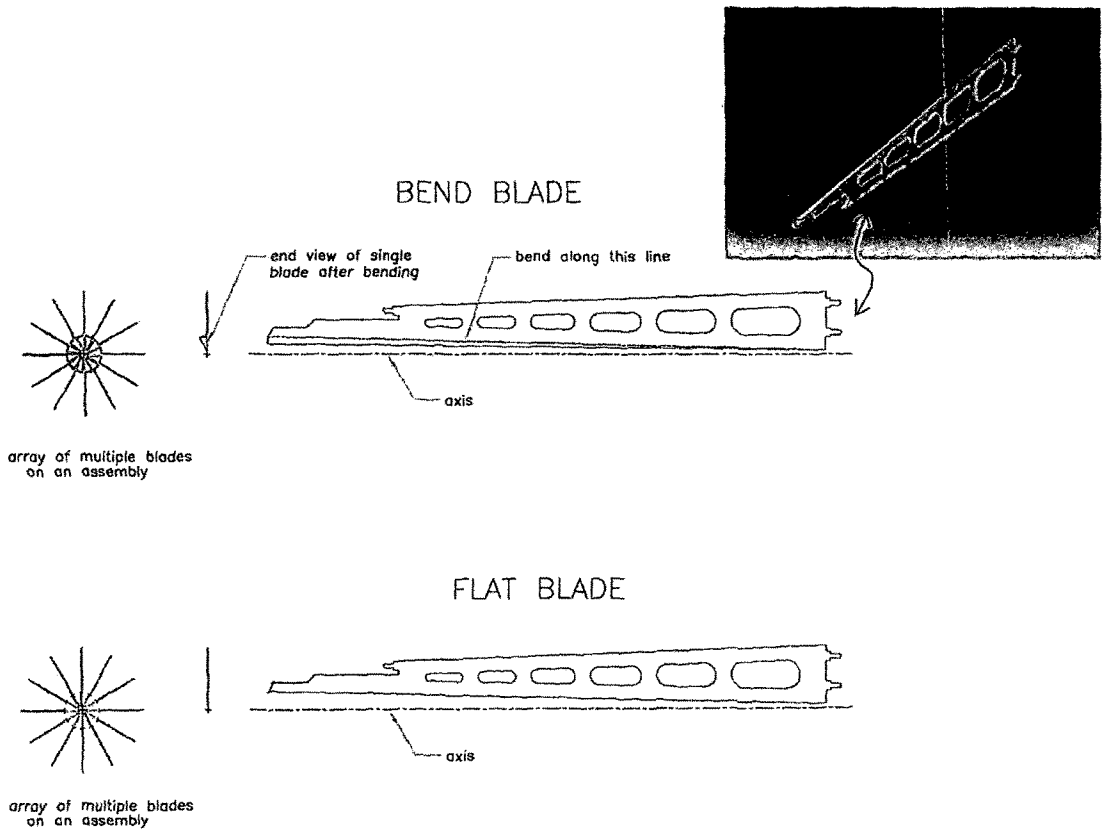
FIG. 6 schematically illustrates electrodes according to various embodiments of the applicant's teachings.

FIG. 6 shows a flat blade, which can comprise a thin, flat piece of metal that can be folded or bent along a line, as shown in FIG. 5, to form a planar surface.

Figure 7:
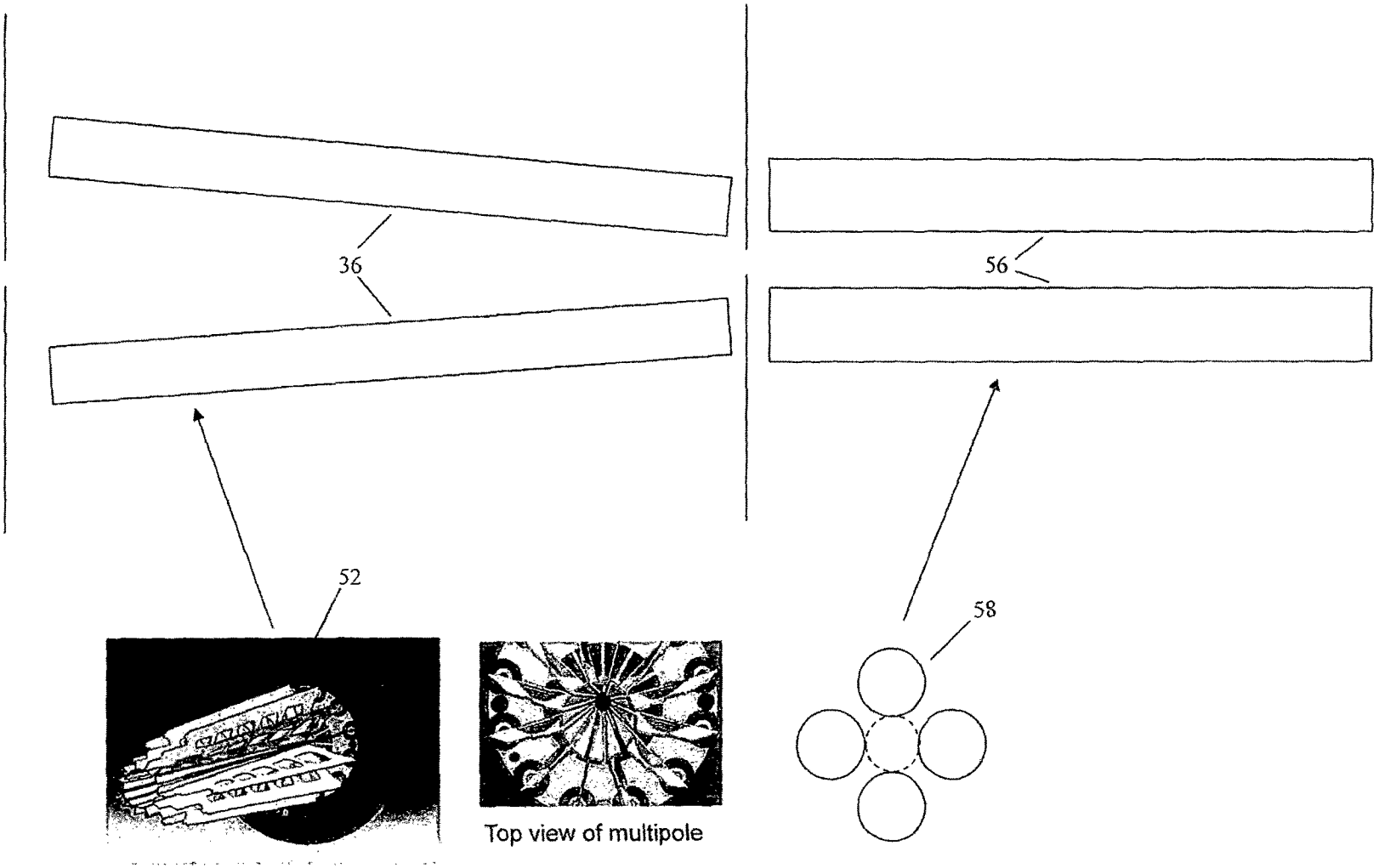
FIG. 7 illustrates a series of ion guides according to the applicant's teachings and shows a cross-sectional view of the ion guides according to various embodiments of the applicant's teachings.

In various embodiments, the at least one ion guide can comprise a series of multipole ion guides as shown in FIG. 7. In the example shown in FIG. 7, the at least one guide 36 can comprise a plurality of electrodes of FIG. 5, and the at least second ion guide 56 can comprise quadrupole rods 58 or any other type of rods. In various aspects, the at least one ion guide can comprise a first ion guide 36 followed by at least a second ion guide 56 wherein the at least second ion guide 56 comprises a smaller diameter than the first ion guide 36. In various aspects, the at least one ion guide and the subsequent series of ion guides can comprise planar electrodes or rods or a combination thereof. In various aspects, the series of multipole ion guides can include any number of electrodes, including quadrupole, hexapole, octapole, higher number of poles, or any combination thereof.

In various embodiments, a method is provided for performing mass analysis comprising providing an ion source for generating ions from a sample in a high pressure region. In various aspects, a vacuum chamber is provided comprising an inlet aperture for passing the ions from the high-pressure region into the vacuum chamber and an exit aperture for passing ions from the vacuum chamber. In various embodiments, at least one ion guide can be provided between the inlet and exit apertures, and the at least one ion guide can comprise an entrance end and an exit end. In various aspects, the at least one ion guide can have a plurality of electrodes arranged around a central axis defining an ion channel, each of the plurality of electrodes being tapered, a planar surface of each of the plurality of tapered electrodes can face the interior of the at least one ion guide, and the surface being gradually narrowed and tilting inward to provide a smaller inscribed radius at the exit end. In various aspects, the surface of each of the plurality of tapered electrodes can be any suitable shape. In various aspects, the surface can be curved. In various aspects, the surface can be convex or concave. In various aspects, a power supply can be provided for providing an RF voltage to the at least one ion guide.

In various embodiments, there is a greater resistance to the flow of radial gas from the interior to the exterior of the ion guide at the exit end than at the entrance end. The resistance to gas flow can be greater at the exit end of the ion guide because the electrodes are thicker at the exit end than the entrance end, thereby reducing the gas conductance or increasing the resistance to the radial gas flow.

In various embodiments, the spacing between adjacent electrodes can be essentially constant over the length of the ion guide. In various aspects, the spacing between adjacent electrodes can be between about 0.4 mm to about 1.5 mm.

In various embodiments, each of the plurality of electrodes gradually becomes thicker towards the narrower exit end of the ion guide, the thickness being in the direction approximately perpendicular to the central axis. In various embodiments, each of the plurality of electrodes can be approximately four times thicker at the exit end than at the entrance end.

In various aspects, the length of the electrodes can between about 5 cm to about 50 cm. In various aspects, the diameter of the inlet aperture is about 0.15 mm to about 5 mm. In various aspects, the diameter of the exit aperture is about 0.5 mm to about 20 mm. In various aspects, the size of the inlet and exit apertures can dictate the diameter of the entrance and exit ends of the ion guide. In various embodiments, the entrance end of the ion guide has a diameter of between about 7 mm and about 12 mm. In various embodiments, the exit end of the ion guide has a diameter between about 1.5 mm and about 2.5 mm.

In various embodiments, the at least one ion guide can be attached to a printed circuit board.

In various aspects, the pressure of the first vacuum chamber can be between about 1 torr to about 100 torr. In various embodiments, the first vacuum chamber can have a pressure between about 6 torr and about 12 torr.

In various embodiments, the at least one ion guide can comprise a multipole. In various embodiments, the multipole can comprise any suitable number of electrodes. In various aspects, the multipole can comprise any even number of electrodes. In various aspects, the multipole is selected from four electrodes, six electrodes, eight electrodes, ten electrodes, twelve electrodes, fourteen electrodes, and sixteen electrodes. In various embodiments, twelve electrodes are provided that are separated by a gap of approximately 0.4 mm and have a thickness in the direction approximately perpendicular to the central axis that increases from approximately 1.5 mm at the entrance end to approximately 6 mm at the exit end.

In various embodiments, the at least one ion guide can comprise a series of multipole ion guides. In various aspects, the at least one guide 36 can comprise the plurality of electrodes of FIG. 2, and the at least second ion guide 56 can comprise quadrupole rods. In various aspects, the at least one ion guide can comprise a first ion guide followed by at least a second ion guide wherein the at least second ion guide comprises a smaller diameter than the first ion guide. In various aspects, the at least one ion guide and the subsequent series of ion guides can comprise planar electrodes or rods or a combination thereof. In various aspects, the series of multipole ion guides can include any number of electrodes, including quadrupole, hexapole, octapole, higher number of poles, or any combination thereof.

In various embodiments, a method is provided for performing mass analysis comprising generating ions from a sample in a high pressure region. In various aspects, the ions can pass into a vacuum chamber comprising an inlet aperture for passing the ions from the high-pressure region into the vacuum chamber. In various aspects, an exit aperture can be provided for passing ions from the vacuum chamber. In various embodiments, there is provided at least one ion guide between the inlet and exit apertures, the at least one ion guide can have an entrance end and an exit end, the at least one ion guide can have a plurality of planar electrodes defining an ion channel, each of the plurality of planar electrodes being folded, or bent, along the length of the ion guide to form a gradually narrowing planar surface that faces the interior of the at least one ion guide. In various aspects, the planar surface can become narrower towards the end of each of the electrodes. In various aspects, each of the plurality of electrodes can be tapered. In various aspects, a second planar surface is approximately orthogonal to the axis of the ion guide. In various aspects, an RF voltage can be applied to the at least one ion guide.

In various embodiments, the plurality of planar electrodes can be folded at about 90 degrees. In various aspects, the length of the electrodes comprises between about 5 cm to about 50 cm. In various aspects, the spacing between the plurality of electrodes can be constant and can be between about 0.1 mm to about 1.5 mm. In various embodiments, the diameter of the inlet aperture can be between about 1.5 mm to about 5 mm. In various aspects, the diameter of the exit aperture can be between about 0.5 mm to about 20 mm. In various aspects, the size of the inlet and exit apertures can dictate the diameter of the entrance and exit ends of the ion guide. In various embodiments, the entrance end of the ion guide has a diameter of between about 7 mm and about 12 mm. In various embodiments, the exit end of the ion guide has a diameter between about 1.5 mm and about 2.5 mm. In various aspects, the at least one ion guide can be attached to a printed circuit board. In various embodiments, the first vacuum chamber can have a pressure between about 1 torr to about 100 torr. In various embodiments, the first vacuum chamber can have a pressure between about 6 torr and about 12 torr. In various aspects, the electrodes can be comprised of metal.

In various embodiments, the at least one ion guide comprises a multipole. In various aspects, the multipole can comprise any even number of electrodes. In various aspects, the multipole is selected from four electrodes, six electrodes, eight electrodes, ten electrodes, twelve electrodes, fourteen electrodes, and sixteen electrodes.

In various embodiments, the at least one ion guide can comprise a series of multipole ion guides. In various aspects, the at least one guide 36 can comprise the plurality of electrodes of FIG. 5, and the at least second ion guide 56 can comprise quadrupole rods. In various embodiments, the at least second ion guide can be comprised of T-shaped electrodes. In various aspects, the at least one ion guide can comprise a first ion guide followed by at least a second ion guide wherein the at least second ion guide comprises a smaller diameter than the first ion guide. In various embodiments, the at least second ion guide can comprise an entrance end diameter that is larger than the exit end diameter. In various aspects, the at least one ion guide and the subsequent series of ion guides can comprise planar electrodes or rods or a combination thereof. In various aspects, the series of multipole ion guides can comprise any number of electrodes, including quadrupole, hexapole, octapole, higher number of poles, or any combination thereof.

All literature and similar material cited in this application, including, but not limited to, patents, patent applications, articles, books, treatises, and web pages, regardless of the format of such literature and similar materials, are expressly incorporated by reference in their entirety. In the event that one or more of the incorporated literature and similar materials differs from or contradicts this application, including but not limited to defined terms, term usage, described techniques, or the like, this application controls.

While the applicants' teachings have been particularly shown and described with reference to specific illustrative embodiments, it should be understood that various changes in form and detail may be made without departing from the spirit and scope of the teachings. Therefore, all embodiments that come within the scope and spirit of the teachings, and equivalents thereto, are claimed. The descriptions and diagrams of the methods of the applicants' teachings should not be read as limited to the described order of elements unless stated to that effect.

While the applicants' teachings have been described in conjunction with various embodiments and examples, it is not intended that the applicants' teachings be limited to such embodiments or examples. On the contrary, the applicants' teachings encompass various alternatives, modifications, and equivalents, as will be appreciated by those of skill in the art, and all such modifications or variations are believed to be within the sphere and scope of the invention.

The invention claimed is:

1. A mass spectrometer comprising:

a. an ion source for generating ions from a sample in a high pressure region;

b. a first vacuum chamber comprising an inlet aperture for passing the ions from the high-pressure region into the vacuum chamber, and an exit aperture for passing ions from the vacuum chamber;

c. at least one ion guide between the inlet and exit apertures, the at least one ion guide having an entrance end and an exit end, the at least one ion guide having a plurality of electrodes arranged around a central axis defining an ion channel, each of the plurality of electrodes being tapered, wherein each of the plurality of electrodes gradually becomes thicker towards the exit end of the ion guide, the thickness being in the direction approximately perpendicular to the central axis, wherein adjacent electrodes are separated by a gap, the gap having a width (G) and a gap thickness (T), wherein the gap thickness (T) is defined by the thickness of the respectively adjacent electrodes and the width (G) is constant along the length of the ion guide, a planar surface of each of the plurality of tapered electrodes facing the interior of the at least one ion guide, and the surface gradually being narrowed and tilted inward to provide a smaller inscribed radius at the exit; and d. a power supply for providing an RF voltage to the at least one ion guide.

2. The mass spectrometer of claim 1 wherein there is a greater resistance to the radial flow of gas from the interior to the exterior of the ion guide at the exit end than at the entrance end.

3. The mass spectrometer of claim 1 wherein the spacing between adjacent electrodes is between about 0.4 mm to about 1.5 mm.

4. The mass spectrometer of claim 1 wherein each of the plurality of electrodes is approximately four times thicker at the exit end than at the entrance end.

5. The mass spectrometer of claim 1 wherein the at least one ion guide comprises a multipole.

6. A method of performing mass analysis comprising:

a. providing an ion source for generating ions from a sample in a high pressure region;

b. providing a first vacuum chamber comprising an inlet aperture for passing the ions from the high-pressure region into the vacuum chamber, and an exit aperture for passing ions from the vacuum chamber;

c. providing at least one ion guide between the inlet and exit apertures, the at least one ion guide having an entrance end and an exit end, the at least one ion guide having a plurality of electrodes arranged around a central axis defining an ion channel, each of the plurality of electrodes being tapered, wherein each of the plurality of electrodes gradually becomes thicker towards the exit end of the ion guide, the thickness being in the direction approximately perpendicular to the central axis, wherein adjacent electrodes are separated by a gap, the gap having a width (G) and a gap thickness (T), wherein the gap thickness (T) is defined by the thickness of the respectively adjacent electrodes and the width (G) is constant along the length of the ion guide, a planar surface of each of the plurality of tapered electrodes facing the interior of the at least one ion guide, and the surface gradually being narrowed and tilted inward to provide a smaller inscribed radius at the exit; and providing a power supply for providing an RF voltage to the at least one ion guide.

7. The method of claim 6 wherein there is a greater resistance to the radial flow of gas from the interior to the exterior of the ion guide at the exit end than at the entrance end.

8. The method of claim 6 wherein the spacing between adjacent electrodes is between about 0.4 mm to about 1.5 mm.

9. The method of claim 6 wherein the electrodes are approximately four times thicker at the exit end than at the entrance end.

10. A mass spectrometer comprising:

a. an ion source for generating ions from a sample in a high pressure region;

b. a first vacuum chamber comprising an inlet aperture for passing the ions from the high-pressure region into the vacuum chamber, and an exit aperture for passing ions from the vacuum chamber;

c. at least one ion guide between the inlet and exit apertures, the at least one ion guide having an entrance end and an exit end, the at least one ion guide having a plurality of planar electrodes arranged around a central axis defining an ion channel, each of the plurality of planar electrodes being folded along the length of the ion guide to form a gradually narrowing planar surface that faces the interior of the at least one ion guide, and a second planar surface is approximately orthogonal to the axis of the ion guide; and d. a power supply for providing an RF voltage to the at least one ion guide.

11. The mass spectrometer of claim 10 wherein the plurality of electrodes is folded at about 90 degrees.

12. The mass spectrometer of claim 10 wherein the at least one ion guide comprises tapered electrodes.

13. The mass spectrometer of claim 10 wherein the spacing between adjacent electrodes is between about 0.1 mm to about 1.5 mm.

14. The mass spectrometer of claim 10 wherein the diameter of the entrance end of the ion guide is between about 7 mm and about 12 mm.

15. The mass spectrometer of claim 10 wherein the diameter of the exit end of the ion guide is between about 1.5 mm and about 2.5 mm.

16. The mass spectrometer of claim 10 wherein the at least one ion guide comprises a multipole.

* * * * *